United States Patent [19]

Shimomura et al.

[11] Patent Number: 4,757,793

[45] Date of Patent: Jul. 19, 1988

[54] FUEL INJECTION CONTROL SYSTEM FOR INTERNAL COMBUSTION ENGINE

[75] Inventors: Setsuhiro Shimomura; Shinji Kojima; Megumu Shimizu; Katsuhiko Kondo, all of Himeji, Japan

[73] Assignee: Mitsubishi Denki Kabushiki Kaisha, Tokyo, Japan

[21] Appl. No.: 4,445

[22] Filed: Jan. 20, 1987

[30] Foreign Application Priority Data

Jan. 22, 1986 [JP] Japan ..... 51-13081

[51] Int. Cl.[4] ..... F02B 3/00

[52] U.S. Cl. ..... 123/488; 123/494

[58] Field of Search ..... 123/488, 494; 73/118.2; 364/431.05

[56] References Cited

U.S. PATENT DOCUMENTS 4,205,377 5/1980 Oyama ..... 123/494
4,523,284 6/1985 Amano ..... 123/494
4,612,895 9/1986 Kuroiwa .
4,644,474 2/1987 Aposchanski ..... 364/431.05

FOREIGN PATENT DOCUMENTS 5773830 10/1980 Japan ..... 123/494

*Primary Examiner*—Ronald B. Cox
*Attorney, Agent, or Firm*—Sughrue, Mion, Zinn, Macpeak and Seas

[57] ABSTRACT

A fuel injection control system for an internal combustion engine having means for limiting a fuel amount to be supplied to the engine according to an output of an air flow sensor to a predetermined upper limit value, and means for correcting the intake air flow rate by the output of the air flow sensor when the opening of an intake air throttle valve is opened at a predetermined value, thereby limiting the output of the sensor to the predetermined upper limit value in case that the output of the sensor increases larger than the actual value and correcting the air density if different from a reference by the correcting means.

10 Claims, 4 Drawing Sheets

FUEL INJECTION CONTROL SYSTEM FOR INTERNAL COMBUSTION ENGINE

BACKGROUND OF THE INVENTION

1. Field of the Invention

The present invention relates to a fuel injection control system for processing a measured intake air flow rate of an internal combustion engine for an automobile.

2. Description of the Prior Art

A conventional fuel injection control system of this type for an internal combustion engine is as shown in FIG. 1. In FIG. 1, numeral 1 designates an internal combustion engine, numeral 2 an electromagnetic drive type injector (a fuel injection valve) for supplying fuel to the engine 1, numeral 3 a hot air type air flow sensor for detecting air flow rate intaken into the engine, numeral 5 an intake air throttle valve provided at a part of an intake air conduit 6 for regulating intake air flow rate to the engine, numeral 7 a coolant temperature sensor for detecting the temperature of the engine, and numeral 8 a controller for calculating a fuel amount to be supplied to the engine according to an air flow rate signal applied from the sensor 3 to apply a pulse of the width corresponding to a fuel amount request. Numeral 9 designates an igniter for generating a pulse signal at every predetermined rotating angle of the engine, numeral 11 a fuel tank, numeral 12 a fuel pump for pressurizing the fuel, numeral 13 a fuel pressure regulator for maintaining the pressure of the fuel to be supplied to the injector 2 constant, and numeral 14 an exhaust conduit. The controller 3 includes an input interface circuit 80, a microprocessor 81 for processing various input signals to calculate a fuel amount to be supplied to the conduit 6 of the engine 1 in accordance with a program memorized in advance in an ROM 82, thereby controlling a drive signal of the injector 2, the ROM 82, an RAM 83 for temporarily memorizing a data during the calculation of the microprocessor 81, and an output interface circuit 84 for driving the injector 2.

The fuel injection control system thus constructed calculates a fuel amount to be supplied to the engine by the controller 8 according to an intake air flow rate signal detected by the sensor 3 to the engine, provides an engine speed by a rotating pulse frequency produced from the igniter 9, and applies a predetermined pulse width to the injector 2 in synchronization with an ignition pulse. It is necessary to set an air-to-fuel ratio to be required for the engine to a rich side if the engine temperature is low, and the control system corrects to increase the pulse width to be applied to the injector 2 according to the temperature signal from the sensor 7. The system also detects the acceleration of the engine by the change in the opening of the valve 5 to correct the air-to-fuel ratio to the rich side.

Though the hot wire type sensor 3 used to control the fuel in the abovementioned fuel injection control system does not need advantageously atmospheric pressure correcting means due to the detection of the intake air flow rate by weight, the sensor 3 is sensitive to the intake air forced back by the pressure reversing the flow of gas from an exhaust valve toward an intake valve of the engine, taking place when the intake valve and the exhaust valve are opened simultaneously, with the result that the sensor 3 detects the intake air flow rate including the additional intake air thus forced back from the exhaust valve toward the intake valve as the intake air flow rate signal, thereby to generate an output signal of the intake air flow rate slightly larger than the actual intake air flow rate. This additional intake air thus forced back is feasibly generated particularly when the engine is operating in the low speed range with the throttle valve fully opened. As shown in FIG. 2 illustrating the detected intake air flow rate with respect to a time, the waveform of the output of the air flow sensor representing the detected intake air flow rate becomes such that the intake air flow rate might increase due to the additional intake air thus forced back from the exhaust valve toward the intake valve even if the true intake air is not intaken at a time $t_R$. As a result, the output of the sensor 3 exhibits a considerably larger value than the true value (designated by broken lines in FIG. 3) when the engine is operating in the low speed range with the throttle valve fully opened, as shown in FIG. 3 illustrating the output of the air flow sensor with respect to the opening of the throttle valve. Since an error of the true intake air due to the additional intake air forced back from the exhaust valve toward the intake valve might reach approx. 50% at the maximum depending upon the layout of the engine and the intake air system, this fuel injection control system cannot be utilized in a practical use with this arrangements. In order to compensate this error there has been proposed, as shown in FIG. 4 illustrating the intake air flow rate Q of the internal combustion engine with the throttle valve fully opened with respect to the engine speed, a method of clipping the intake air flow rate at a value (e.g., larger by 10%) slightly larger than the average value b of the true intake air flow rate of the engine, for example, as designated by "MAX" in FIG. 4 by ignoring the output signal a produced from the sensor 3 by setting in advance the maximum intake air flow rate (including an irregularity) to be intaken to the engine in the ROM 82. According to this method, since the clipping value designated by the "MAX" in FIG. 4 might set the maximum intake air flow rate of the engine at a sea level and ambient temperature, the air-to-fuel ratio is largely shifted to a rich side due to a decrease in the actual air density if an automobile with the engine travels on a high ground with low atmospheric air pressure or the engine intakes high temperature air, thereby possibly to cause a high fuel consumption and also to fail to ignite the engine. Further, there might arise a problem that the air-to-fuel ratio is shifted to a lean side if the intake air temperature is low. A method of subtracting a certain value from the actual intake air by judging the waveform of the additional intake air flow rate forced back from the exhaust valve toward the intake valve of the engine has been proposed as a method of correcting an error of the detected intake air flow rate of the air flow sensor 3 due to the additional intake air flow rate forced back from the exhaust valve toward the intake valve. However, the waveform of the intake air flow rate due to the additional intake air flow rate forced back from the exhaust valve toward the intake valve variably depends upon the engine speed and the opening of the throttle valve, and it was difficult to accurately correct the intake air flow rate of the engine.

In the conventional fuel injection control system as described above, the hot wire type air flow sensor 3 has detected larger intake air flow rate than the true value due to the additional intake air flow rate forced back from the exhaust valve toward the intake valve of the engine taking place when the engine rotates in the low speed range with the throttle valve fully opened, and the system has such drawbacks that cannot accordingly properly controls the air-to-fuel ratio in a certain operating range.

SUMMARY OF THE INVENTION

An object of this invention is, therefore, to provide a fuel injection control system for an internal combustion engine free from the above-mentioned drawbacks and disadvantages in the prior art control system and capable of accurately controlling an air-to-fuel ratio of the engine even if an atmospheric air pressure is drfterent from that at a sea level or atmospherical air temperature is different from an ambient temperature.

In order to achieve the above and other objects, a fuel injection control system for an internal combustion engine according to the present invention comprises:

- a hot wire type air flow sensor for detecting an intake air flow rate of the engine;
- a controller for calculating a fuel amount to be supplied to the engine according to an output signal of the sensor;
- a fuel injection valve driven by the controller for injecting a predetermined fuel amount;

said controller including

- means for limiting the output of the sensor or a fuel amount to be supplied to the engine in accordance with the output of the sensor to a predetermined upper limit value (MAX), and
- means for correcting the value of the upper limit value (MAX) according to a correction value held by calculating the correction value by the relationship between the output of the sensor of the state that the engine speed is set at a predetermined value and an intake air throttle valve for regulating the intake air flow rate of the engine is opened at a predetermined value or the value of the fuel amount to be supplied to the engine, calculated according to the output of the sensor and a value memorized in advance and holding the correction value.

BRIEF DESCRIPTION OF THE DRAWINGS

The above objects and features of the present invention will be more clearly understood by the following detailed description of preferred embodiments in conjunction with the accompanying drawings in which.

DESCRIPTION OF THE PREFERRED EMBODIMENTS

Figure 1:
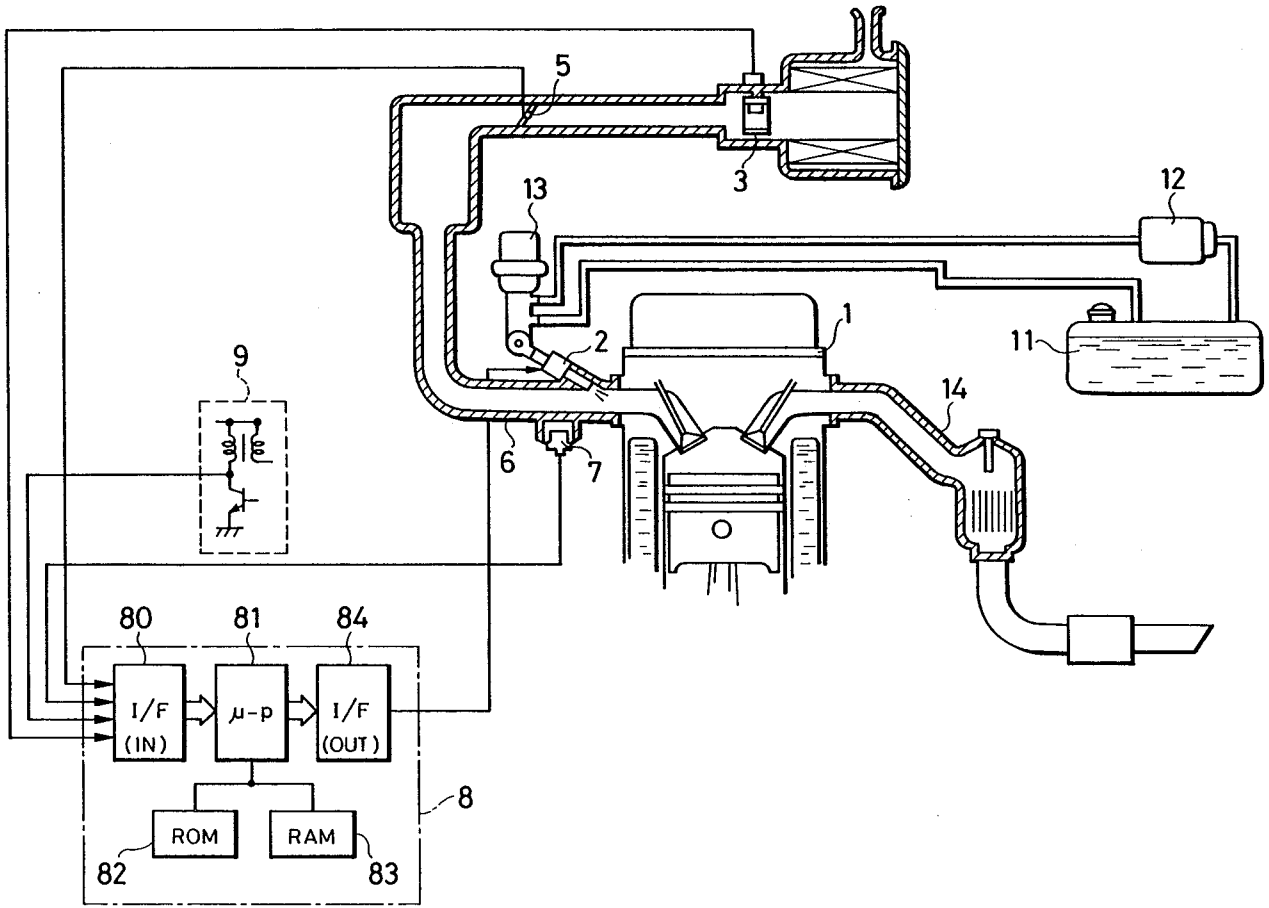
FIG. 1 is a diagram of a basic structure of prior art and present invention.
Figure 2:
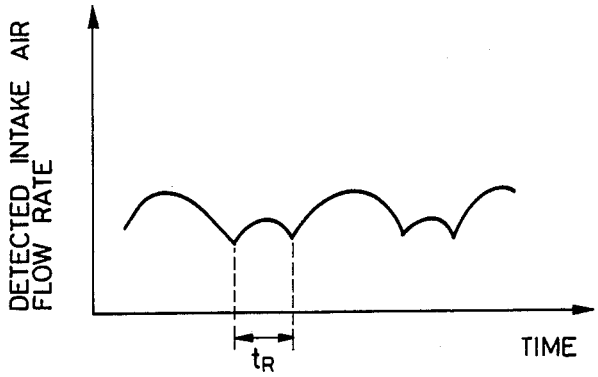
FIGS. 2 and 3 are characteristic diagrams of detected intake air flow rate with respect to time due to additional intake air flow rate forced back from an exhaust valve toward an intake valve of an internal combustion engine and of the output of an air flow sensor with respect to the opening of a throttle valve.
Figure 3:
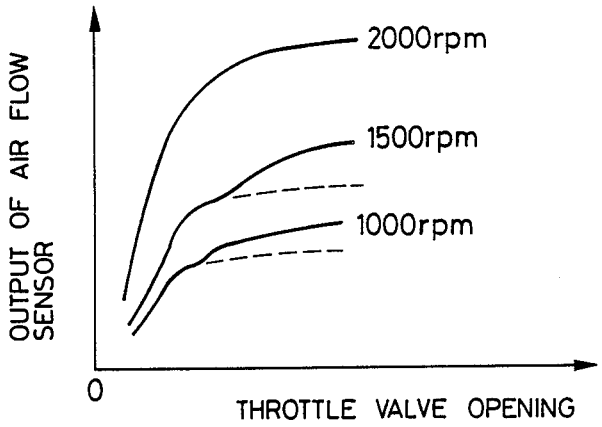
Figure 4:
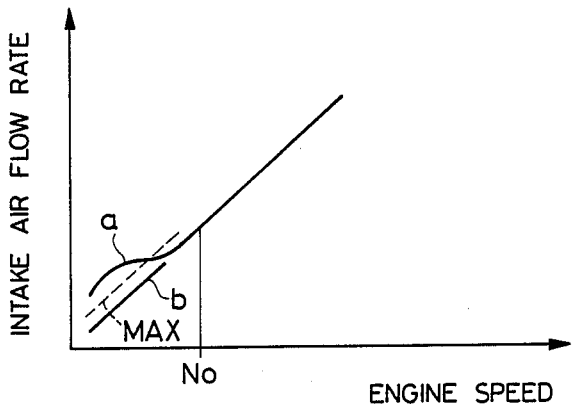
FIG. 4 is a characteristic diagram of a method of correcting an error of an intake air flow rate with respect to an engine speed due to additional intake air flow rate forced back from the exhaust valve toward the intake valve of the conventional engine.
Figure 5:
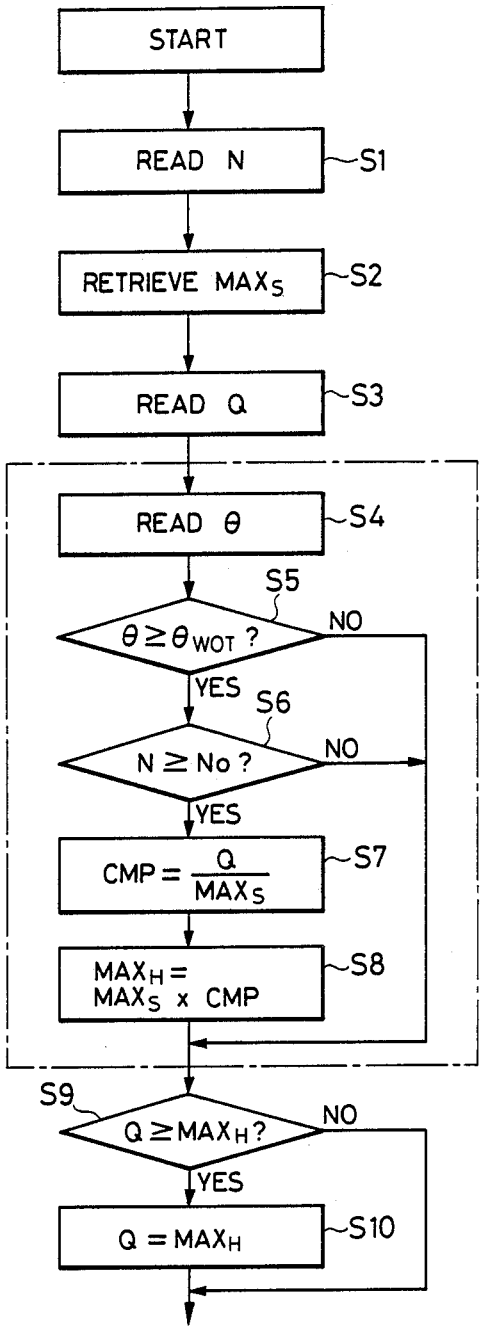
FIG. 5 is a flow chart showing the essential operation of a fuel injection control system according to the present invention.
Figure 6:
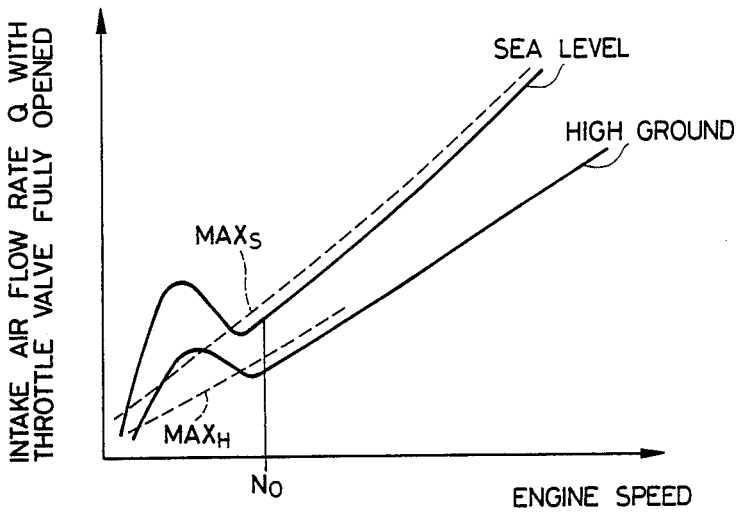
FIG. 6 is a characteristic diagram of actually correcting the intake air flow rate according to the present invention.

The structure of a fuel injection control system for an internal combustion engine according to an embodiment of the present invention is substantially the same as that in FIG. 1, but the functions of an ROM 82 are particularly different. Referring to FIG. 5 illustrating a flow chart of the operation of the control system according to the embodiment of the invention in which a section surrounded by a dotted chain line is different from the conventional fuel injection control system. The section not directly relative to the invention will be omitted. An engine speed N is read at step S1, and the maximum intake air flow rate MAXs corresponding the engine speed N is retrieved with the speed N at step S3. The retrieving means may employ means for calculating with a function of an engine speed as an input or means for retrieving a map data for memorizing in advance data of MAXs corresponding to engine speeds. The data of the MAXs are provided at a sea level. An intake air flow rate Q that the engine intakes is then read at step S3. In the conventional control system, the operation is shifted from the step S3 over to step S9. In this embodiment, the operation is shifted to step S4. A throttle valve opening $\theta$ is read at the step S4. The throttle valve opening $\theta$ is compared with a predetermined value $\theta_{WOT}$ at step S5. The $\theta_{WOT}$ is a value representing the throttle valve opening corresponding to the throttle fully opened. The operation executes the processes after step S6 in the state that the throttle valve is fully opened and the engine intakes the maximum intake air flow rate. The $\theta_{WOT}$ employs a map data for memorizing a value slightly smaller than the actual full opening angle of the throttle value or the opening regarded as being effectively fully opened corresponding to the engine speed. The engine speed N is compared with a predetermined value $N_0$ at step S6. The $N_0$ represents the engine speed corresponding to that of the limit for causing an error in the output of the air flow sensor 3 due to the additional intake air flow rate forced back from the exhaust valve toward the intake valve of the engine as shown in FIG. 6 illustrating the intake air flow rate Q with the throttle valve fully opened with respect to the engine speed. When the engine speed N is higher than the $N_0$ and the output of the sensor 3 is normal, the operation is shifted to step S7. CMP=Q/MAXs is calculated with the MAXs and the intake air flow rate Q (which is the intake air flow rate normally measured with the throttle valve fully opened in this case) produced previously at step S7 to produce a correction value CMP. Since the MAXs is determined corresponding to the intake air flow rate of the throttle valve fully opened at a sea level, the CMP becomes a value proportional to the ratio of the density of the present intake air to that of the intake air at a sea level. The CMP and the MAXs thus provided are multiplied to produce $MAX_H$ at step S8. The $MAX_H$ is memorized in a memory devices of a pair as the MAXs determined corresponding to engine speeds. The output of the sensor 3 (intake air flow rate Q) is compared with the $MAX_H$ at step S9. In case of $Q \geqq MAX_H$, the operation is shifted to step S10, and the intake air flow rate is clipped at $Q = MAX_H$. The result of the above processes is as shown in FIG. 6, and an error due to the additional intake air forced back from the exhaust valve toward the intake valve of the engine is clipped by the valid maximum intake air flow rate $MAX_H$ at a high ground. In case of $Q<MAX_H$ at step the S9, the intake air flow rate is not clipped at the $Q=MAX_H$, but the read Q is fed to the next step (not shown) of calculating the fuel supply as it is. In case of $\theta<\theta_{WOT}$ at the step S5 and $N<N_0$ at step S6, normal output of the sensor 3 is not produced with the throttle valve fully opened. Therefore, the step of providing the correction value CMP is not executed, but the operation is shifted to the step S9 to eliminate the erroneous correction value.

In the embodiment shown in FIG. 5, the case that the maximum intake air flow rate MAX is corrected has been described. However, the present invention is not limited to the particular embodiment. For example, a method of correcting the fuel flow rate to be supplied corresponding to the intake air flow rate Q and hence the maximum value of the drive pulse width of the injector 2 by the correction value CMP may be executed.

Figure 7:
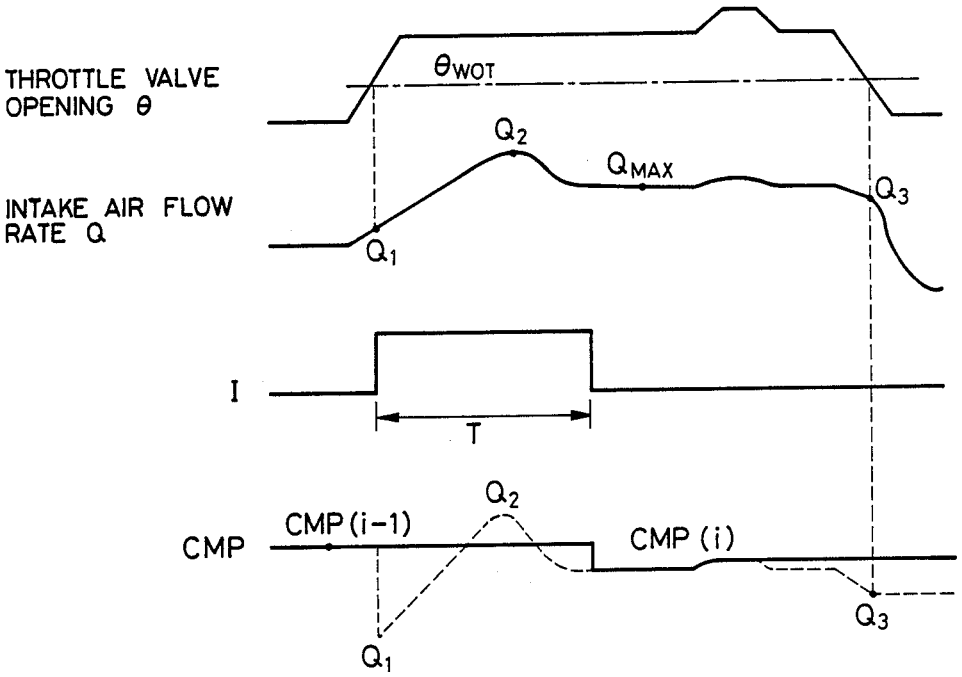
FIG. 7 is a time chart showing a method of correcting the intake air flow rate at a transient time of the invention. In the drawings, same reference numerals depict same structural elements.

In FIG. 7 illustrating a method of correcting at a transient time of the invention, in which the intake air flow rate Q varies in response to the opening and closing of the throttle valve 5, the intake air flow rate Q becomes $Q_1$ due to a response delay when the throttle valve 5 is abruptly opened to exceed the full-opening angle $\theta_{WOT}$, which does not reach the final value, i.e., the intake air flow rate $Q_{MAX}$ with the throttle valve fully opened. Subsequently, the intake air flow rate overshoots due to the volume of the intake air conduit 6 to arrive at $Q_2$. Thereafter, the intake air flow rate Q reaches the true value $Q_{MAX}$. Then, the rntake air flow rate Q slightly decreases until the throttle valve 5 is abruptly closed to exceed the full-opening angle $\theta_{WOT}$, and becomes $Q_3$. This takes place due to the reasons that the throttle valve 5 has, though fully opened, a slight pressure loss of opening dependency and the delay of detecting the opening of the throttle valve 5 cannot be ignored. Therefore, it is preferable to eliminate the correction value CMP due to the intake air flow rate during the period that the transient state of the intake arr flow rate Q takes place so as to ensure the advantages of the invention. In FIG. 7, the waveform I is a signal for detecting the acceleration of the engine due to at least any one of the throttle valve opening, the intake air flow rate and the engine speed by the conventional means to inhibit the production of a correction value CMP during the period T (calculating or holding the correction value CMP). Thus, an inconvenient correction value corresponding to the transient time as designated by a broken line in the waveform of the correction value CMP is ignored, and the correction value CMP (i-1) produced in the past is continued as it is. It is convenient that the period T is given by the time limit predetermined to correspond to the various dimensions of the intake air system, and it is complete if the period is constituted to generate correspondingly during the period that the above-described acceleration is continuously detected. Then, the intake air flow rate $Q=Q_{MAX}$ after the period T is finished is employed to calculate and hold the correction value CMP(i). This correction value CMP(i) is provided to hold the maximum value of the value generated during the period that the opening of the throttle valve 5 exceeds the $\theta_{WOT}$. Thus, the correction value decreases until the opening of the throttle valve 5 exceeds the $\theta_{WOT}$, and an inconvenience as designated by a broken line (corresponding to $Q_3$) in FIG. 7 does not take place.

Even if the error of the correction value CMP due to the transient state is suppressed as described above, it cannot be avoided to present a slight variation in the correction value CMP. Therefore, it is preferable to pass the correction value CMP through a filter of suitable frequency characteristic and then use for the correction. Since it is not preferable to vary the maximum intake air flow rate $MAX_H$ after the correction due to the slight variation in the correction value CMP at a sea level, it is preferable to process to protect by fixing to 1 in a range that the correction value CMP is near 1.

In the embodiment described above, a method of employing the correction value CMP to correct the maximum upper limit value of the intake air flow rate has been described. However, the invention is not limited to the particular embodiment. For example, the value relative to the fuel supply amount provided corresponding to the intake air flow rate and hence the maximum value is provided as the value (Q/N) produced by dividing the intake air flow rate Q by the engine speed N in an injector drive pulse width or a rotation synchronization injection system, and the value can be corrected. Further, a method of providing the correction value by the ratio of the maximum intake air flow rate to the upper limit value MAX determined in advance at a sea level has been described as a method of correcting the intake air flow rate. However, the invention is not limited to the particular embodiment. For example, the MAX can be corrected also by replacing the $Q_{MAX2}$ produced by calculating according to the relationship $Q_{MAX2} \div Q_{MAX} \times (N_2/N_1)$ of the engine speed $N_1$ of producing the maximum intake air flow rate $Q_{MAX}$ and the apparent maximum intake air flow rate $Q_{MAX2}$ at the engine speed $N_2$ to be corrected by the MAX value determined at a sea level. A memory for memorizing the correction value thus provided as described above is preferably nonvolatile. Because a calculation of the correction value is not executed until the engine speed after a power source is turned ON is operated over $N_0$ in FIG. 6 but the possibility of operating the engine with the MAXs of no correction is presented, and in case that the correction value is memorized in a nonvolatile memory, a preferable correction can be executed immediately after the engine is started by the correction value of previous time.

As described hereinbefore, according to the present invention, a predetermined upper limit value for limiting the output of the conventional air flow sensor is determined at a sea level and the disadvantage that the value is employed at a high ground such that a rich shift of the air-to-fuel ratio takes place is removed by providing the correction value corresponding to the high altitude from the output of the air flow sensor and correcting the upper limit value by the correction value. Parameters such as throttle valve opening used for the correction are employed hereinafter but particular sensor is not necessary, thereby to eliminate an inconvenience of an increased cost.

What is claimed is:

1. A fuel injection control system for an internal combustion engine, comprising:

(a) a hot wire type air flow sensor for detecting an intake air flow rate of the engine;

(b) a controller for calculating a fuel amount to be supplied to the engine according to an output signal of the sensor; and (c) a fuel injection valve driven by the controller for injecting a predetermined fuel amount;

(d) said controller including:

(1) means for limiting a quantity selected from the group comprising the output of the sensor and a fuel amount to be supplied to the engine in accordance with the output of the sensor, to a predetermined upper limit value (MAX), and (2) means for correcting the upper limit value (MAX) according to a stored correction value determined by calculating the relationship between the output of the sensor when the engine speed is set at a predetermined value and an intake air throttle valve for regulating the intake air flow rate of the engine when said throttle valve is opened to a predetermined value, or the value of the fuel amount to be supplied to the engine, calculated according to the output of the sensor and a value memorized in advance.

2. A fuel injection control system as claimed in claim 1, wherein said correcting means calculates the correction value when at least any of the opening of the intake air throttle valve, the engine speed and the output of the air flow sensor exceeds a predetermined value at a transient state.

3. A fuel injection control system as claimed in claims 1 or 2, wherein said correcting means holds the maximum value of the correction value calculated during a period when the engine speed and the intake air throttle valve are in predetermined states.

4. A fuel injection control system as claimed in claims 1 or 2, wherein said correcting means calculates the correction value in accordance with a ratio between one of the output of the air flow sensor and a value relative to a fuel amount to be supplied to the engine calculated according to the output of the air flow sensor, and a value memorized in advance.

5. A fuel injection control system as claimed in claims 1 or 2, wherein said correcting means stores the correction value in a nonvolatile memory.

6. A method of correcting the maximum intake air flow rate in an internal combustion engine having an air flow sensor, a throttle valve, an intake valve, and an exhaust valve, comprising the steps of:

(a) reading the engine speed, (b) retrieving the maximum intake air flow rate corresponding to the read engine speed, (c) reading the intake air flow rate of the engine, (d) reading the throttle valve opening, (e) comparing the throttle valve opening with a predetermined value corresponding to the throttle valve being fully opened, (f) comparing the engine speed with a predetermined engine speed corresponding to a limit for causing an error in the output of the air flow sensor when additional intake air is forced back from the exhaust valve toward the intake valve of the engine, and (g) calculating a correction value by dividing the intake air flow rate by the maximum intake air flow rate.

7. A method as claimed in claim 6, wherein the retrieving step includes a calculation using a function of the engine speed as an input.

8. A method as claimed in claim 6, wherein the retrieving step includes retrieving map data specifying maximum intake air flow rates corresponding to engine speeds.

9. A method as claimed in claim 6, wherein the correction value is proportional to the ratio of the density of the actual intake air to that of intake air at sea level.

10. A method as claimed in claim 6, further comprising the step of:

(a) multiplying the correction value by the maximum intake air flow rate to produce a product value, (b) comparing the output of the air flow sensor with the product value, and (c) clipping the correction value at the product value when the intake air flow rate is equal to or larger than the product value.

* * * * *